United States Patent [19]

Jacoby et al.

[11] Patent Number: 5,001,459

[45] Date of Patent: Mar. 19, 1991

[54] ESCALATOR HANDRAIL GUARD WARNING DEVICE

[75] Inventors: Herbert Jacoby, Farmington; David L. Steel, Burlington, both of Conn.

[73] Assignee: Otis Elevator Company, Farmington, Conn.

[21] Appl. No.: 527,399

[22] Filed: May 23, 1990

[51] Int. Cl.[5] ..... G08B 13/14

[52] U.S. Cl. ..... 340/568; 198/323; 340/529; 340/563

[58] Field of Search ..... 340/568, 561–563, 340/529; 198/322–323, 338; 200/61.41

[56] References Cited

U.S. PATENT DOCUMENTS

| | | | |
|---|---|---|---|
| 3,947,832 | 3/1976 | Rosgen et al. | 198/323 X |
| 4,629,052 | 12/1986 | Kitamura | 198/323 |
| 4,664,247 | 5/1987 | Wolf et al. | 198/323 |
| 4,800,998 | 1/1989 | Myrick | 198/323 |
| 4,924,995 | 5/1990 | Adrian et al. | 198/323 |

*Primary Examiner*—Glen R. Swann, III
*Assistant Examiner*—Thomas J. Mullen, Jr.
*Attorney, Agent, or Firm*—William W. Jones

[57] ABSTRACT

The location on an escalator where the handrail reenters the balustrade is provided with an electrical field projector which will establish a limited extent electrical field around the handrail reentry housing. The field is established with a pair of antennae disposed adjacent to the handrail reentry. The antennae are preferably connected to the main AC power source for the escalator, and can be angularly adjusted to focus the field that they project. Shrouds are positioned adjacent to each antenna to confine the lateral extent of the field. An object entering the field will cause a field disturbance which creates a signal setting off an audible alarm. Subsequent stopping of the escalator can ensue if the disturbance is not removed in a predetermined amount of time.

7 Claims, 2 Drawing Sheets

ESCALATOR HANDRAIL GUARD WARNING DEVICE

TECHNICAL FIELD

This invention relates to a detector for use on an escalator handrail reentry. More particularly, the detector of this invention projects an electrical field which is disrupted upon entry of a foreign object within its ambit.

BACKGROUND ART

Escalator handrail reentry ports, i.e., the opening under the escalator exit newel where the handrail begins its hidden return run to the entrance newel, will usually be provided with some sort of object detector to ensure that things do not get drawn into the reentry port with the handrail. These detectors will be operably connected to some sort of switch which can sound an alarm or even turn the escalator off if an object is detected at the reentry port. The prior art detectors of this type are generally contact detectors, that is to say, they must be physically contacted by the intruding object before they will activate. These types of detectors are prone to mischief by children and adolescents who will play or tamper with them. It would, therefore, be desirable to provide a handrail reentry detector which will activate to at least sound an alarm before it is contacted or touched.

DISCLOSURE OF THE INVENTION

This invention relates to an escalator handrail reentry detector which will activate an alarm when the reentry port is approached by a foreign object. The detector need not be physically contacted to sound the alarm. In the event the intrusion continues after the alarm is sounded, the detector will turn the escalator off. The detector uses two antennae which are disposed below and on either side of the handrail reentry port. The antennae propagate an electrostatic field through which the handrail moves prior to passing through the reentry port. When a foreign object enters the electrostatic field, the latter is disturbed and the detector is triggered. Initially, an audible alarm can be sounded to draw attention to the area in question. If the object is not withdrawn within a preset period, for example two seconds, after sounding of the alarm, then the detector can cause the escalator to stop moving. The device consists of a balanced bridge capacitive-type detector placed at each handrail reentry position. The detector may be modularized for upgrading an existing escalator. Each detector module would contain the antennae pair, power supply, oscillator, pre-amps, and output relays. A metal guard or shroud can be included on the module casing, the guard being shaped to produce a confined field to ensure proper protection in the proper location. The antennae can be movably mounted on the module so that they can provide a properly directed and circumscribed electrostatic field for the handrail. The antenna guards can also be movably adjustable.

It is therefore an object of this invention to provide an escalator handrail reentry detector which can detect foreign objects on the handrail in the vicinity of the handrail reentry without physically contacting such foreign objects.

It is a further object of this invention to provide a detector of the character described which propagates an electrostatic field in the vicinity of the handrail reentry.

It is another object of this invention to provide a detector of the character described where the electrostatic field may be confined and focused on the handrail.

These and other objects and advantages of the invention will become more readily apparent from the following detailed description of a preferred embodiment thereof when taken in conjunction with the accompanying drawings, in which:

BRIEF DESCRIPTION OF THE DRAWINGS

FIG. 2 is a fragmented elevational view of the handrail reentry port showing the detector face-on;

BEST MODE FOR CARRYING OUT THE INVENTION

Figure 1:
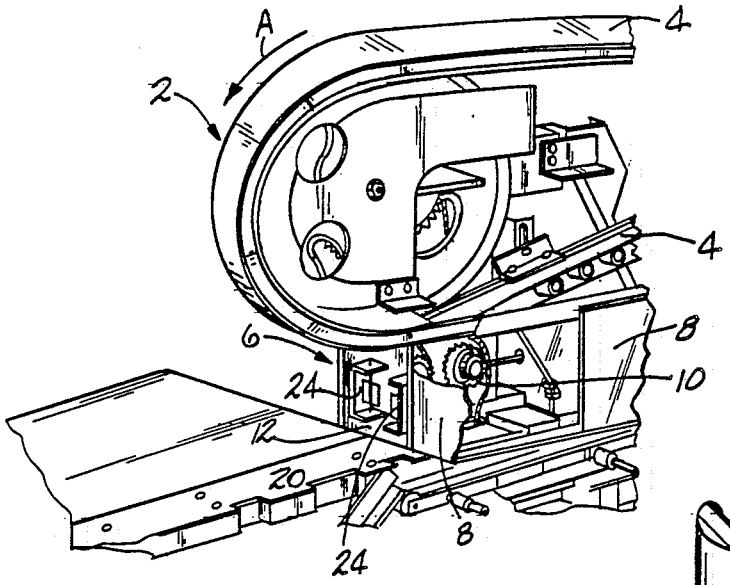
FIG. 1 is a perspective view, partially broken away, of a handrail reentry newel on an escalator.
Figure 2:
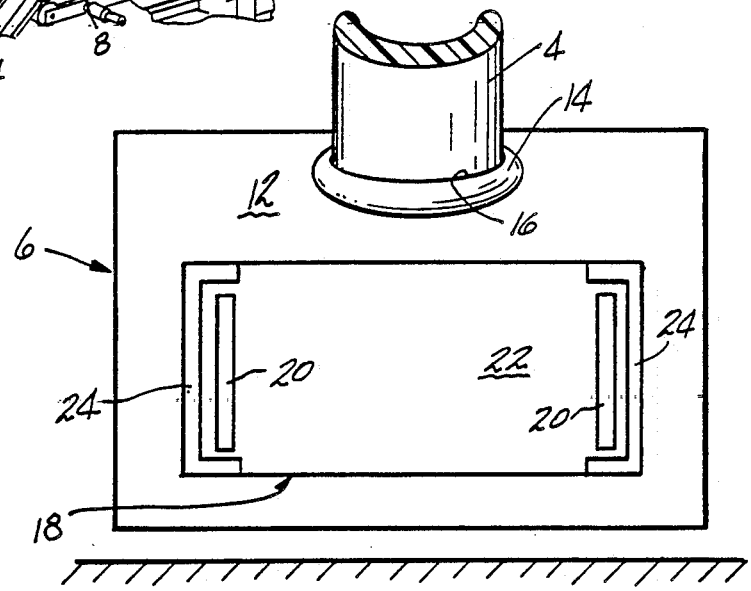

Referring now to the drawings, the exit newel area, denoted generally by the numeral 2, of an escalator or moving walkway is shown. The handrail 4 moves around the newel 2 in the direction of the arrow A and enters a housing 6 adjacent to the tread skirts 8. The handrail drive sprockets 10 are mounted in the housing 6 and drive rollers which engage the handrail 4. The front face 12 of the housing 6 is provided with a collar 14 which defines a handrail reentry port 16 into which the handrail 4 is drawn. The detector, denoted generally by the numeral 18, is mounted in the housing 6 below the handrail 4. The antennae 20 are mounted in the front wall 22 of the detector 18 inside of projecting shrouds or guards 24 which act as blinders for the antennae 20 and focus the field generated by the antennae 20 on the handrail 4 and the locus thereof in front of the housing 6.

Figure 3:
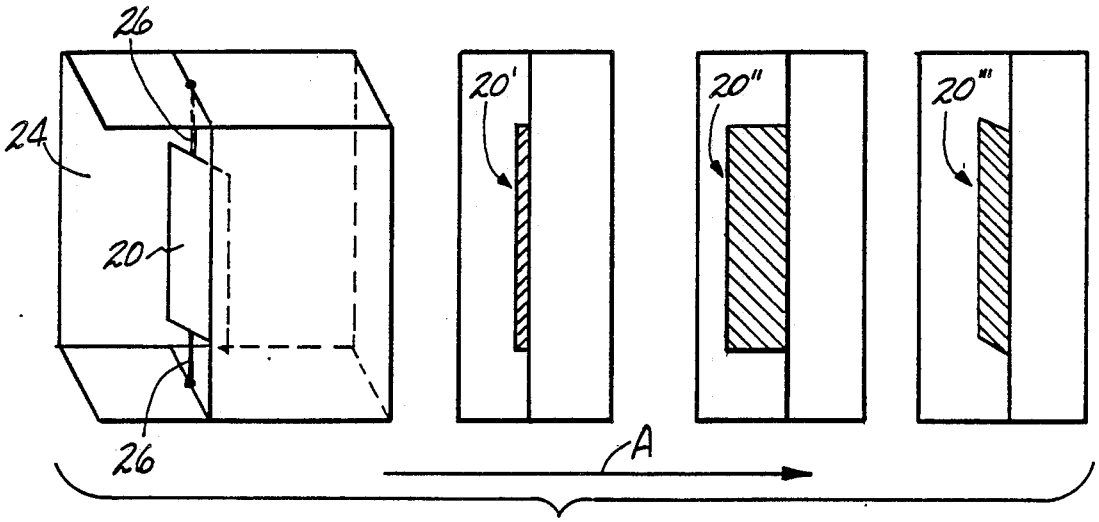
FIG. 3 is a schematic view of one of the detector antennae showing how it can be aimed at the handrail with its propagation field varying relative to the position of the antenna.

FIG. 3 illustrates the manner in which the antennae 20 can be mounted to allow it to alter its propagation direction relative to the direction of movement of the handrail, which is indicated by the arrow A. The antennae 20 can be mounted on a pivot member 26. Thus the antenna 20 can be positioned as shown at 20' wherein its direction of field propagation is parallel to the arrow A, or at 20'' where field propagation is perpendicular to the arrow A, or at 20''', where field propagation is at an included angle of 45° to the arrow A, or of course, any intermediate position. The length of the field out in front of the detector front wall 22, and the intensity of the field at and below the handrail can thus be adjusted and controlled for different specific applications.

Figure 4:
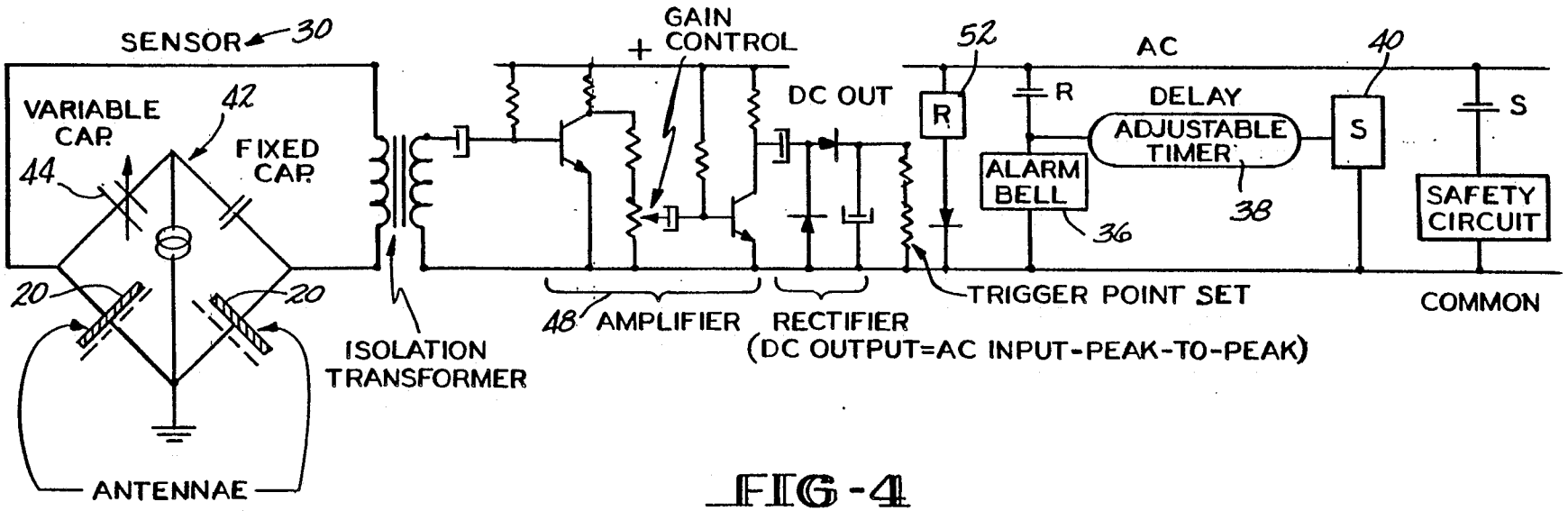
FIG. 4 is a schematic circuit diagram of the circuitry used in the detector.
Figure 5:
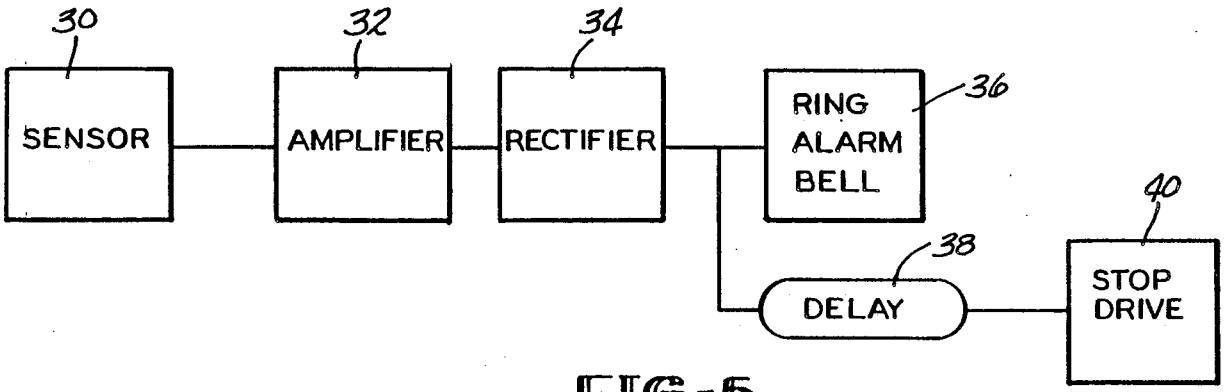
FIG. 5 is a schematic view of the detector in its modular form.

Referring now to FIGS. 4 and 5, there is shown the electronic components of the device. FIG. 5 shows the system schematically wherein the sensor subassembly 30 is connected to an amplifier 32 which amplifies the output of the sensor 30. A rectifier 34 converts the output from the amplifier 32 from AC to DC, and the DC output of the rectifier 34 activates an alarm bell 36 and starts a timer delay 38. If the signal from the rectifier 34 remains for a certain time period, as for example two seconds, a stop drive device 40, such as a brake or a switch interrupting power to the escalator, will be activated and the escalator will stop.

FIG. 4 shows in greater detail the structure of the various electronic components. The sensor 30, which includes the antennae 20, preferably uses a balanced bridge capacitance to set up an electrostatic field, shaped and positioned to monitor the area to be protected. The balanced bridge 42 is energized via an oscillator and is tuned or balanced by using a variable capacitor 44 against a fixed capacitor 46. The bridge 42 will become unbalanced when a foreign object enters the electrostatic field in the protected area thereby completing the bridge circuit. The oscillator can be a 1KC, 200V peak-to-peak device; and the fixed and variable capacitors can be 120PF.

The resultant bridge output is coupled (and isolated) to an amplifier 48 to enlarge the small AC bridge output voltage. The amplifier 48 contains a gain control to set an output at a level appropriate to feed a rectifier (voltage doubler) whereby a voltage of about 10 volts DC is obtained when the protected area is invaded. The resultant DC voltage is fed to an adjustable trigger circuit 50 that activates a relay 52. The contacts of the relay 52 are connected to the alarm 36 and to the delay timer 38. As previously noted, once the delay timer 38 runs out, the "stop escalator" device 40 trips and the escalator will stop. If the foreign object is retracted from the sensor field before the delay 38 runs out, then the escalator will continue to run and the alarm will be silenced. Once the escalator is turned off by an intruding object in the field, it will not automatically restart.

It will be appreciated that the system is composed of off-the-shelf components and is thus simple to manufacture and easy to assemble. The use of the variably positionable antennae or energy projector allows accurate focusing of the field on the area to be surveyed. While the preferred embodiment of the invention employs an electrical field and circuitry, it will be understood that light field or sonar field detection could also be used in connection with this invention.

Since many changes and variations of the disclosed embodiment of the invention may be made without departing from the inventive concept, it is not intended to limit the invention otherwise than as required by the appended claims.

What is claimed is:

1. A moving handrail reentry warning device for use at the handrail reentry port portion of a moving passenger transporter, said warning device comprising:

(a) a sensible alarm associated with the passenger transporter;

(b) means for propagating a detection field about the handrail upstream of the direction of movement of the handrail adjacent to the handrail reentry port; and (c) means interconnecting said alarm and said means for propagating and operable to activate said alarm whenever a foreign object enters the detection field.

2. The warning device of claim 1 wherein said means for propagating includes at least one movable antenna which can be selectively focused on the handrail to limit the extent of the detection field.

3. The warning device of claim 2 wherein said means for propagating includes two movable antennae, one of which is disposed on either side of said handrail reentry port.

4. The warning device of claim 3 further comprising guard means adjacent to each antenna on the side thereof opposite said handrail, said guard means being operable to restart lateral propagation of the detection field.

5. The warning device of claim 3 wherein said antennae are operable to propagate an electrostatic detection field.

6. The warning device of claim 5 wherein said means for propagating comprises a balanced bridge capacitance assembly which becomes unbalanced when a foreign object enters the detection field, and said means interconnecting comprises a voltage amplifier connected to said capacitance assembly to increase voltage from said capacitance assembly; a rectifier connected to said amplifier to produce a rectified DC voltage; and a relay interconnecting said rectifier and said alarm to transmit the rectified voltage output to said alarm to activate the latter.

7. The warning device of claim 6 further comprising delay means connected to said relay and to a transporter stopping circuit and operable to transmit said rectified DC voltage to said stopping circuit a predetermined time period after said alarm has been activated.

* * * * *